United States Patent [19]

Williams

[11] Patent Number: 5,042,810

[45] Date of Patent: Aug. 27, 1991

[54] ROULETTE APPARATUS

[75] Inventor: Martin G. Williams, London, England

[73] Assignee: Technical Casino Services, Ltd., London, England

[21] Appl. No.: 477,502

[22] Filed: Feb. 9, 1990

[30] Foreign Application Priority Data

Feb. 13, 1989 [GB] United Kingdom ..... 8903160

[51] Int. Cl.[5] ..... A63F 5/00

[52] U.S. Cl. ..... 273/142; 273/138 A; 273/143 R

[58] Field of Search ..... 273/138 A, 142 R, 142 B, 273/143 R

[56] References Cited

U.S. PATENT DOCUMENTS 4,837,728 6/1989 Barrie et al. ..... 273/143 R

FOREIGN PATENT DOCUMENTS 0194388 9/1986 European Pat. Off. ..... 273/142 B
2656024 6/1978 Fed. Rep. of Germany ... 273/142 B
2165386 4/1986 United Kingdom ..... 273/143 R
2181589 4/1987 United Kingdom ..... 273/143 R
2204436 11/1988 United Kingdom ..... 273/138 A

*Primary Examiner*—Edward M. Coven
*Assistant Examiner*—Raleigh W. Chiu
*Attorney, Agent, or Firm*—Antonelli, Terry, Stout & Kraus

[57] ABSTRACT

In order to increase interest in a roulette game, roulette apparatus is provided with a counter to accumulate, and a display for displaying in the vicinity of the roulette table, a jackpot fund which increases as play progresses. A jackpot is paid out of the jackpot fund according to prescribed criteria. A parallel fund, not displayed to the players, may also be accumulated for replenishing the jackpot fund rapidly after a jackpot payout occurs.

10 Claims, 1 Drawing Sheet

ROULETTE APPARATUS

Figure 1:
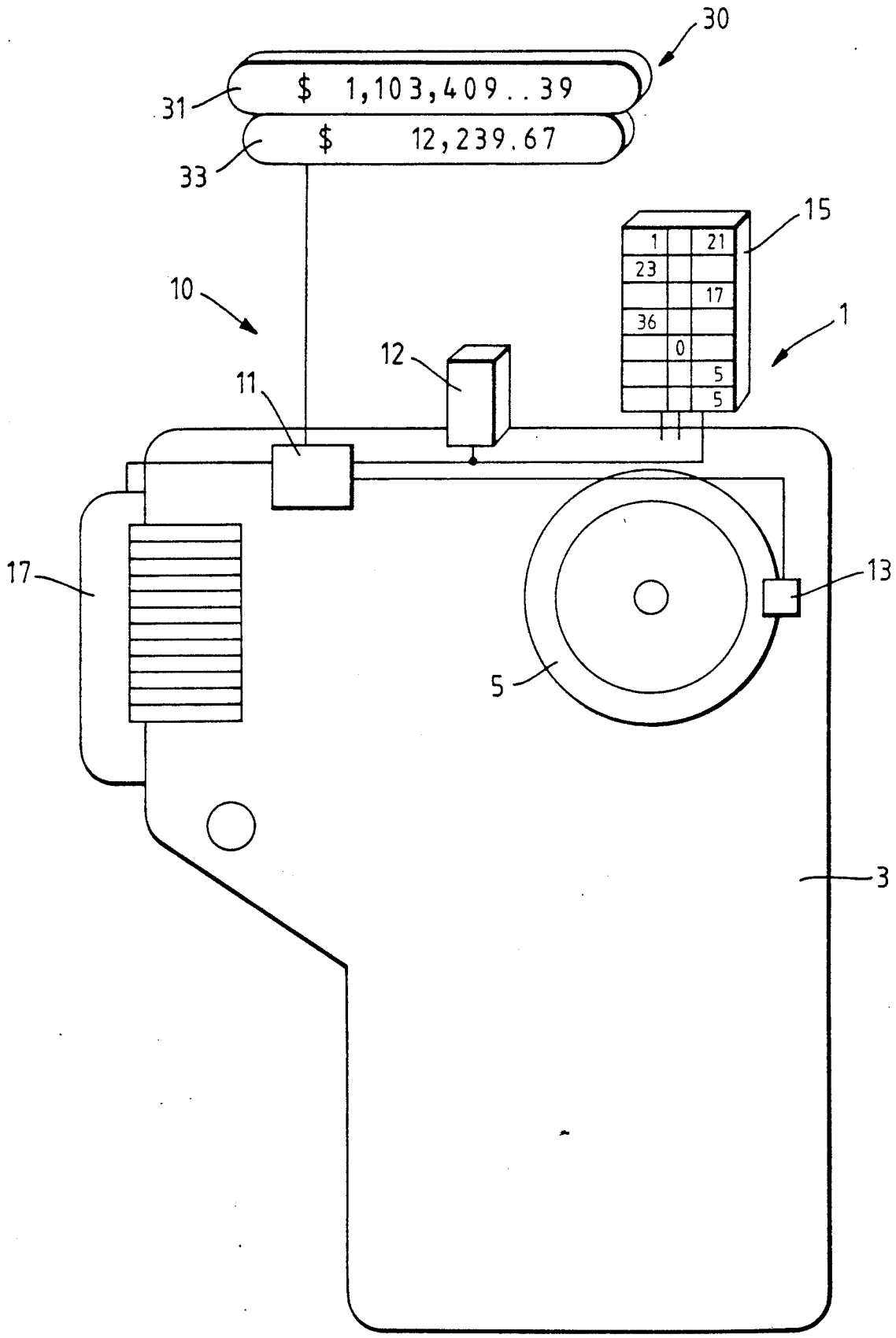

The present invention relates to the game of roulette and to apparatus for use in playing roulette.

Conventional roulette and the manner of playing it is sufficiently well known and popular as not to require description here. Roulette is less popular in the United States, because the odds of a house win are significantly greater than in the game as played in the United Kingdom. In the US, the roulette wheel has two house (green) positions, increasing the chances of a house win (5.26% as against 2.7%). Although this could in principle be alleviated by adopting the UK-style wheel layout, this would be impractical in view of the installed base of wheels in the US, and in any event the change might not in itself be sufficient to enhance significantly the popularity of the game.

The present invention seeks to make the game of roulette, particularly but not exclusively the US version, more appealing to players without significantly departing from the established principles of the game or requiring changes to the established wheel layout.

In one aspect, the invention proposes an addition to the conventional game of roulette in which the house accumulates one or more jackpot funds based on the turnover of the roulette table; a jackpot is paid out in prescribed circumstances, for example when a particular sequence of winning numbers (or colours) occurs—e.g., when the same winning number occurs three games in a row; a further jackpot, which may be more substantial, may be paid out, may follow the first jackpot—e.g., in the example just mentioned when the number in question occurs a fourth time in a row.

Preferably, to increase player-interest in the jackpot feature, the amount(s) currently available in the jackpot fund(s) is displayed in the vicinity of the roulette table; this will be seen to increase as the fund accumulates. The percentage of the table turnover paid into the jackpot fund(s) may be varied as the fund accumulates, either upwards or downwards. As a compromise between promoting player-interest and economy, the proportion may be relatively high initially and then be reduced as the fund accumulated increases. Once a jackpot has been paid out, it is desirable that the jackpot fund be seen by the players to be replenished rapidly and to facilitate this, in parallel with the "public", i.e., displayed, jackpot fund, a "hidden" replacement fund (whose contents are not displayed to the players) is maintained and incremented in tandem with the displayed amount. Again, this fund may be incremented on the basis of table-turnover, preferably with the percentages paid into the public and hidden funds varying as the displayed amount increases (so the once that amount has reached a substantial level, the replacement fund can be rapidly increased in anticipation being used to replace the amount paid out on occurrence of a pay-out.

The present invention also provides a roulette apparatus for use in playing roulette in accordance with conventional rules for conducting the play at a table but with modified payout rules in conjunction with a roulette wheel. The apparatus includes a detector for detecting the winning number in each roulette game played on the wheel, a jackpot counter for storing a value representing an amount to be paid out upon the occurrence of a jackpot. The value in the counter is incremented as the play proceeds and is displayed on a display. A detector monitors the result of each game to determine whether a jackpot has occurred. If a jackpot has occurred, then the jackpot is paid out, otherwise the value in the counter is incremented and ready for the next game.

The jackpot condition can be defined by the occurrence of the same winning number a fixed number of times such as, for example, three in a row and there may be a further jackpot to be paid out in accordance with a further jackpot condition. In this latter situation, a further counter stores a value representing the amount to be paid out upon the occurrence of the further jackpot condition, and a further display displays the amount represented by the value stored in the further counter. A second detector means is implemented so as to detect the occurrence of each jackpot condition.

The value stored in the counter or counters may be incremented as a proportion of the turnover of the table on which the game is being played. A known type of roulette chip counter/sorter may be used to provide a signal indicative of the table turnover by detecting the number and color of the chips cleaned from the table at the end of each game. The proportion of table turnover may be fixed or varied in some fashion in dependence upon the value stored by the counter or it may be set by an operator such as, for example, the croupier. Furthermore, the "hidden" jackpot replenishment fund or funds may be maintained by a similar arrangement of a counter and display, although the display would, of course, be arranged so as to be visible only to the operator.

The detectors, jackpot counter or counters and display or displays may be implemented by suitable programming of a known type of house management system as may be the calculation of the proportional proportions of the table-turnover by which the counter value or values is to be incremented.

The invention will be further described by way of non-limitative example with reference to the accompanying drawings in which:

FIG. 1 is a somewhat schematic perspective view of a roulette system in accordance with the present invention.

The roulette system 1 shown in FIG. 1 comprises a roulette table 3 with a roulette wheel 5 (which may be laid out in the U.S. or U.K. style, i.e. with two or one zeroes). The wheel 3 is associated with what is known as a table management system 10 which comprises a suitably programmed microcomputer 11, which may be of the well known IBM PC (or IBM PC compatible) type, or, more preferably, a dedicated microcontroller with associated display and keypad, an optical number reader 13, which reads from the roulette wheel the number at which the ball comes to rest, and a display 15 which displays the last few winning numbers in black, red and green columns. This display is prominently sited relative to the table so as to be readily visible to the players and persons watching. One commercially available form of house management system suitable as the system 10 is a system manufactured by Scientific Computer Installation Systems Ltd of Jersey. The system 10 can perform useful security functions such as ensuring that the wheel 5 is spun correctly and that the ball is not placed in a number by the dealing croupier.

Also associated with the table 3 is an automatic chip sorter and counter 17 into which chips from the table 3 are funneled and sorted by colour; the sorter/counter 17 electronically signals the number and colour of each chip passing through it to the computer 11. Such sorters are well known and understood by those skilled in the art and so a detailed description is unnecessary; a suitable commercially available unit is the "Chipper Champ" distributed in the UK by Technical Casino Services Ltd.

The system so far described can be used to play a conventional game of roulette.

In accordance with the present invention, the system is supplemented by a jackpot display 30 and the game is played according to the conventional rules appropriate to the type of roulette wheel 3 (US or UK) in question supplemented by the jackpot features described herein.

In operation of the system, at the end of the game, the chip layout is cleared and swept into the sorter/counter 17 where the chips are sorted by colour (if there is more than one colour of chip) and the counter sorter 17 signals to the computer 11 the number and cash values of the chips. The computer 10 is thus provided with an indication of the turnover of the table.

The computer 11 is programmed to maintain in software four internal meters, one pair for each of the two jackpots. The contents of the "public meters" of the two jackpots are displayed on respective displays 31 and 33 of the jackpot display 30. Each jackpot also has associated with it a further "hidden" meter (hidden in the sense that its contents are visible only to the croupier, for example by being displayed on a local display associated with the computer 11). These two "hidden" meters are also incremented at the end of each game by a percentage of the table turnover during the preceding game and are maintained so as to replenish the jackpot funds when one or other jackpot is paid out. The percentages of table turnover added to the public and hidden meters may either be selected by a program running on the computer 11 or alternatively the percentages can be set by the croupier by inputting the relevant values to the computer 11 via the keypad 12 associated with it.

As described above, play proceeds in accordance with conventional rules of roulette with the public and hidden meters being suitably incremented at the end of each game. The computer 11 is programmed to detect the occurrence of the situation appropriate to payout of the two jackpots. The first jackpot is paid when a number occurs 3 times in a row, and is paid to the player who is playing with the colour against which that number is permanently allocated. For example, red=1, 6, 14, 18; blue=2, 7, 15, 19; yellow=3, 89, 20, 30 etc. The second jackpot then immediately becomes available to be won and is won if the same number occurs on the next spin. If no one is playing the colour when the number occurs, then the jackpot is not won and the amount continues to be incremented on the jackpot display. For example, the lower jackpot, displayed on the display 31 may be paid out when three successive games produce the same winning number and in those circumstances the higher jackpot, displayed on the display 33 may be paid out if the following game also produces the same winning number. Obviously, on occurrence of the jackpot, the croupier pays out the amount indicated to the winning player.

Pay out of one or other jackpot empties the fund associated with the respective public meter and the software zeroes the public meter. The purpose of maintaining the hidden meter is so that when one of the two jackpots is paid out, the contents of the corresponding hidden meter is transferred to the public meter so that the amount available to be won as the jackpot can be seen immediately to return to a value sufficient to promote interest in the game.

It should be apparent that having the percentages added to the public and hidden meters under control of the croupier provides scope for increasing excitement in the course of game play, and also maintaining interest once the jackpot has been paid out.

The writing of software to implement the additional game features should be a matter of routine for those skilled in the art of roulette house management system design. The software in computer 11 could, for example, follow the following pseudo-code algorithm:

```
Initialise_program_variables:
Reset_last_number_display;                          {the display 15}
Reset_hidden_and_public_meters;
Reset_jackpot_display;                              {the displays 30}
Repeat
  Wait_for_game_over;                               {loop until ball stops}
  Read_winning_number;                              {from reader 13}
  Test_for_first_jackpot                            {the lower jackpot 31}
  If happened then
   begin
    zero_public_meter_1;                            {dealer pays out}
    transfer_hidden_meter_1_contents_to_public_meter_1;
    zero_hidden_meter_1;
   end
  Else
   begin
    Test_for_second_jackpot:                        {the higher jackpot 33}
    If happened then
      begin
        zero_public_meter_2;
        transfer_hidden_meter_2_contents_to_public
        meter_2;
        zero_hidden_meter_2;
      end
    Else                                            {neither jackpot occurred}
      begin
        read_turnover_from_sorter:
        display_turnover_to_operator:
        input_update_percentages;                   {croupier sets
                                                    how much to increment}
        update_meters;
      end;
    End;
Until finished;                                     {play at table over}
```

I claim:

1. A roulette apparatus for use in playing roulette at a roulette table according to conventional rules for the conduct of the play at the table but with modified payout rules varied in favor of the players, the apparatus comprising:

(a) a roulette wheel;

(b) a first detector operatively associated with the roulette wheel for detecting the winning number in each roulette game played on the wheel;

(c) at least one jackpot counter device operatively connected to the first detector for storing a value representing the amount to be paid out in accordance with said modified payout rules on occurrence of a jackpot, the jackpot occurring when a predetermined jackpot condition is satisfied;

(d) at least one display operatively connected to the at least one jackpot counter device for displaying the amount of money represented by the value stored in the at least one jackpot counter device;

(e) a second detector operatively connected to the first detector for monitoring the winning number of each game played a the roulette table for determining whether the predetermined jackpot condition has occurred; and (f) means operatively connected to the second detector and to the at least one jackpot counter device for incrementing the value stored by the at least one jackpot counter in the event that the second detector determines that the jackpot condition has not occurred and for signaling, in the event that the second detector determines that the jackpot condition has occurred, that a payout of the jackpot should take place.

2. An apparatus according to claim 1, and including means defining the jackpot condition by the occurrence of the same winning number a fixed number of times.

3. An apparatus according to claim 1, and including a further jackpot counter for storing a value representing the amount to be paid out upon the occurrence of a further jackpot condition, a further display for displaying the value stored in said further jackpot counter, and wherein said second detector is operative to detect the first-mentioned and further jackpot conditions.

4. An apparatus according to claim 1, wherein the at least one jackpot counter and the at least one display include, respectively a counter and display associated with a fund to replenish, in the event of a payout on a jackpot condition, the amount available to be paid out on occurrence of a subsequent jackpot, the display associated with the replenishment fund being displayed privately to the operator.

5. A roulette apparatus for use in playing roulette in conjunction with a roulette wheel at a roulette table, comprising:

(a) means for detecting the winning number in each roulette game played on the wheel;

(b) at least one jackpot counter for storing a value representing the amount to be paid out on occurrence of a jackpot condition;

(c) at least one means for displaying the amount represented by the value stored in the jackpot counter (b);

(d) means for incrementing the value stored by the jackpot counter (b);

(e) means for detecting the occurrence of a jackpot condition; and (f) means for incrementing the contents of the at least one counter as a proportion of the turnover at the table at which the apparatus is used.

6. An apparatus according to claim 5, and including means for enabling an operator to set said proportion.

7. A roulette apparatus for use in playing roulette in conjunction with a roulette wheel at a roulette table, comprising:

(a) means for detecting the winning number in each roulette game played on the wheel;

(b) at least one jackpot counter for storing a value representing the amount to be paid out on occurrence of a jackpot condition;

(c) at least one means for displaying the amount represented by the value stored in the jackpot counter (b);

(d) means for incrementing the value stored by the jackpot counter (b);

(e) means for detecting the occurrence of a jackpot condition; and (f) a roulette chip counter/sorter operative to provide a signal indicative of the table turnover by detecting the number and colour of the chips cleaned from the table a the end of each game.

8. A method of playing roulette at a roulette table using a roulette wheel in the course of play of which the house carries out the steps of:

accumulating as play progresses at least one jackpot fund based on the turnover of the roulette table;

displaying in a manner visible to players in the vicinity of the roulette table the amount in at least one such jackpot fund; and paying out a jackpot, in prescribed circumstances, from the displayed jackpot fund.

9. A method according to claim 8, in which the step of accumulating the at least one jackpot fund includes the step of accumulating, in parallel to the displayed jackpot fund, a further fund, not displayed to the players, and which further includes the step of replenishing the displayed jackpot fund from the further fund when a payout from the displayed fund.

10. A method according to claim 8 and including the step of varying, as play between jackpot payouts progresses, the proportion of table turnover incrementally accumulated into the at least one jackpot fund.

* * * * *